US008932139B2

(12) United States Patent
Brosnan et al.

(10) Patent No.: US 8,932,139 B2
(45) Date of Patent: Jan. 13, 2015

(54) ELECTRONIC GAMING DEVICE TROUBLESHOOTING AND LOGGING

(75) Inventors: William R. Brosnan, Reno, NV (US); Dwayne R. Nelson, Las Vegas, NV (US); Grace Elizabeth Cathcart Crosley, Reno, NV (US); Joshua A. Gentry, Reno, NV (US); Tony Raymond Escalera, Sparks, NV (US)

(73) Assignee: IGT, Las Vegas, NV (US)

( * ) Notice: Subject to any disclaimer, the term of this patent is extended or adjusted under 35 U.S.C. 154(b) by 177 days.

(21) Appl. No.: 13/236,434

(22) Filed: Sep. 19, 2011

(65) Prior Publication Data

US 2013/0072304 A1 Mar. 21, 2013

(51) Int. Cl.
*A63F 9/24* (2006.01)
*G07F 17/32* (2006.01)

(52) U.S. Cl.
CPC ..... *G07F 17/3234* (2013.01)
USPC ..... 463/42; 463/43

(58) Field of Classification Search
CPC ..... A63F 9/24; G07F 17/32
USPC ..... 714/25, 48–57; 463/42–43
See application file for complete search history.

(56) References Cited

U.S. PATENT DOCUMENTS

| | | | | |
|---|---|---|---|---|
| 6,754,854 | B2 * | 6/2004 | Kurrasch | 714/47.2 |
| 7,201,660 | B2 * | 4/2007 | Kiely et al. | 463/42 |
| 7,793,164 | B2 * | 9/2010 | Smith | 714/52 |
| 2005/0081108 | A1 * | 4/2005 | Shabalin | 714/38 |
| 2006/0035713 | A1 * | 2/2006 | Cockerille et al. | 463/42 |
| 2006/0264253 | A1 * | 11/2006 | Trobia | 463/19 |
| 2007/0101208 | A1 * | 5/2007 | Mohr | 714/57 |
| 2010/0203961 | A1 * | 8/2010 | Burke et al. | 463/29 |

* cited by examiner

*Primary Examiner* — David L Lewis
*Assistant Examiner* — Shauna-Kay Hall
(74) *Attorney, Agent, or Firm* — Neal, Gerber & Eisenberg LLP

(57) ABSTRACT

A method and system for electronic gaming device troubleshooting and logging includes detecting an error condition of an electronic gaming device, an electronic game device having a processor, memory and an interface; generating a reference link for a detected error condition; and conveying a reference link. A system includes an electronic gaming device having a processor, memory and an interface. An electronic gaming device may include a detector configured to detect an error condition of an electronic gaming device; a reference link generator configured to generate a reference link characterizing a detected error condition; and an interface configured to convey a reference link.

18 Claims, 5 Drawing Sheets

ELECTRONIC GAMING DEVICE TROUBLESHOOTING AND LOGGING

BACKGROUND

1. Field of the Described Embodiments

The described embodiments relate generally to gaming systems and methods, such as, but not limited to, gaming systems and methods deployed in a casino enterprise.

2. Description of Related Art

Many of today's gaming casinos and other entertainment locations feature different multi-user gaming systems such as slot machines and video poker machines. These gaming machines typically include pay-for-play (e.g., entertainment arcades, amusement arcades, and so on) or pay-for-wager (e.g., casino, video lottery, fixed odds betting, and so on).

Gaming devices may be typically processor-controlled. Microprocessor based gaming devices may include a number of hardware and software components to provide a wide variety of game types and game playing capabilities. A typical electronic gaming device comprises a central processing unit or master gaming controller, generally referred to as CPU below. A CPU controls various combinations of hardware and software devices and components that encourage game play, allow a user to play a game on a gaming device, and control payouts and other awards.

Software components may include, for example, boot and initialization routines, various game play programs and subroutines, credit and payout routines, image and audio generation programs, various component modules and a random number generator, among others. Exemplary hardware devices may include bill validators, coin acceptors, card readers, keypads, buttons, levers, touch screens, coin hoppers, ticket printers, user tracking units and the like.

Many gaming devices may be provided with special features and additional circuitry that differentiate them from general-purpose computers, such as a laptop or desktop personal computer ("PC"). Because gaming devices may be highly regulated to ensure fairness, and in many cases may be operable to dispense monetary awards of a large amount of money, their hardware and software architectures often differ significantly from those of general-purpose computers, even though both PCs and gaming devices employ processors to control a variety of devices.

Although variety of devices available for a PC may be greater than on a gaming device, gaming devices still have unique device requirements that differ from PCs. Adapting PC technologies to gaming devices is quite difficult for a number of reasons, such as regulations and security requirements that may be placed upon gaming devices, a harsh environment in which gaming devices operate, and fault tolerance requirements. Further, techniques and methods for solving a problem in the PC industry, such as device compatibility and connectivity issues, might not be adequate in the gaming environment.

Software on gaming devices used to generate games of chance has been statically designed to prevent cheating by an operator of a gaming device. For example, coding instructions on non-volatile memory must be approved by gaming regulators and installed in the presence of a gaming official from the gaming jurisdiction. Any changes may have to be approved by the gaming jurisdiction. There may also be code validation requirements in the gaming industry that affect both hardware and software designs on gaming devices. In addition, monetary devices such as coin dispensers, bill validators, ticket printers and computing devices that may be used to govern input and output of cash to a gaming device have security requirements that may not be typically addressed in PCs.

For example, a fault or a weakness tolerated in a PC, such as security holes in software or frequent crashes, may not be tolerated in a gaming machine because in a gaming machine these faults may lead to a direct loss of funds from a gaming machine, such as stolen cash or loss of revenue when a gaming machine is not operating properly. To address some of these issues, a number of hardware/software components and architectures may be utilized in gaming machines that may not be typically found in general purpose computing devices, such as PCs. These hardware/software components and architectures include, but may not be limited to, items such as watchdog timers, voltage monitoring systems, state-based software architectures and supporting hardware, specialized communication interfaces, security monitoring, and trusted memory.

Components and architectures of a gaming device may be important for an electronic gaming device to properly function. However, if an electronic gaming device is not operating properly, an error must be efficiently determined and corrected. The more quickly an error condition may be diagnosed and remedied, the more quickly a gaming machine may be put back into service to serve customers.

SUMMARY OF THE DESCRIBED EMBODIMENTS

A method for simplified electronic gaming device troubleshooting and logging is described. A method may be generally characterized as including: detecting an error condition of an electronic gaming device, an electronic game device having a processor, memory and an interface; generating a reference link for a detected error condition; and conveying a reference link.

A system for simplified electronic gaming device troubleshooting and logging is described. A system, in general terms, may include an electronic gaming device having a processor, memory and an interface. An electronic gaming device may include a detector configured to detect an error condition of an electronic gaming device; a reference link generator configured to generate a reference link characterizing a detected error condition; and an interface configured to convey a reference link.

In some embodiments, a computer program product may allow instructions stored in a non-transitory computer readable storage medium, the instructions when executed by a processor causing a processor to perform a method, in general terms, as including receiving a reference link identifying an error condition existing at an electronic gaming machine; accessing, based on a reference link, reference information associated with resolving an error condition, and generating a display of reference information to a user to facilitate resolving an error condition at an electronic gaming device.

DESCRIBED EMBODIMENTS

Numerous specific details are set forth below to provide a thorough understanding of concepts underlying the described embodiments. It may be apparent, however, to one skilled in art that described embodiments may be practiced without some or all of these specific details. In other instances, well-known process steps have not been described in detail in order to avoid unnecessarily obscuring the underlying concepts.

A system and method for electronic gaming device trouble-shooting is described. An arrangement provides easy access to an adequate amount of information to diagnose and remedy gaming machine malfunctions. As described in more detail herein, according to various embodiments, error detection is provided at an electronic gaming device, and additional information regarding an error is provided at another electronic gaming device or on a computing device (e.g., a mobile computing device).

Figure 1:
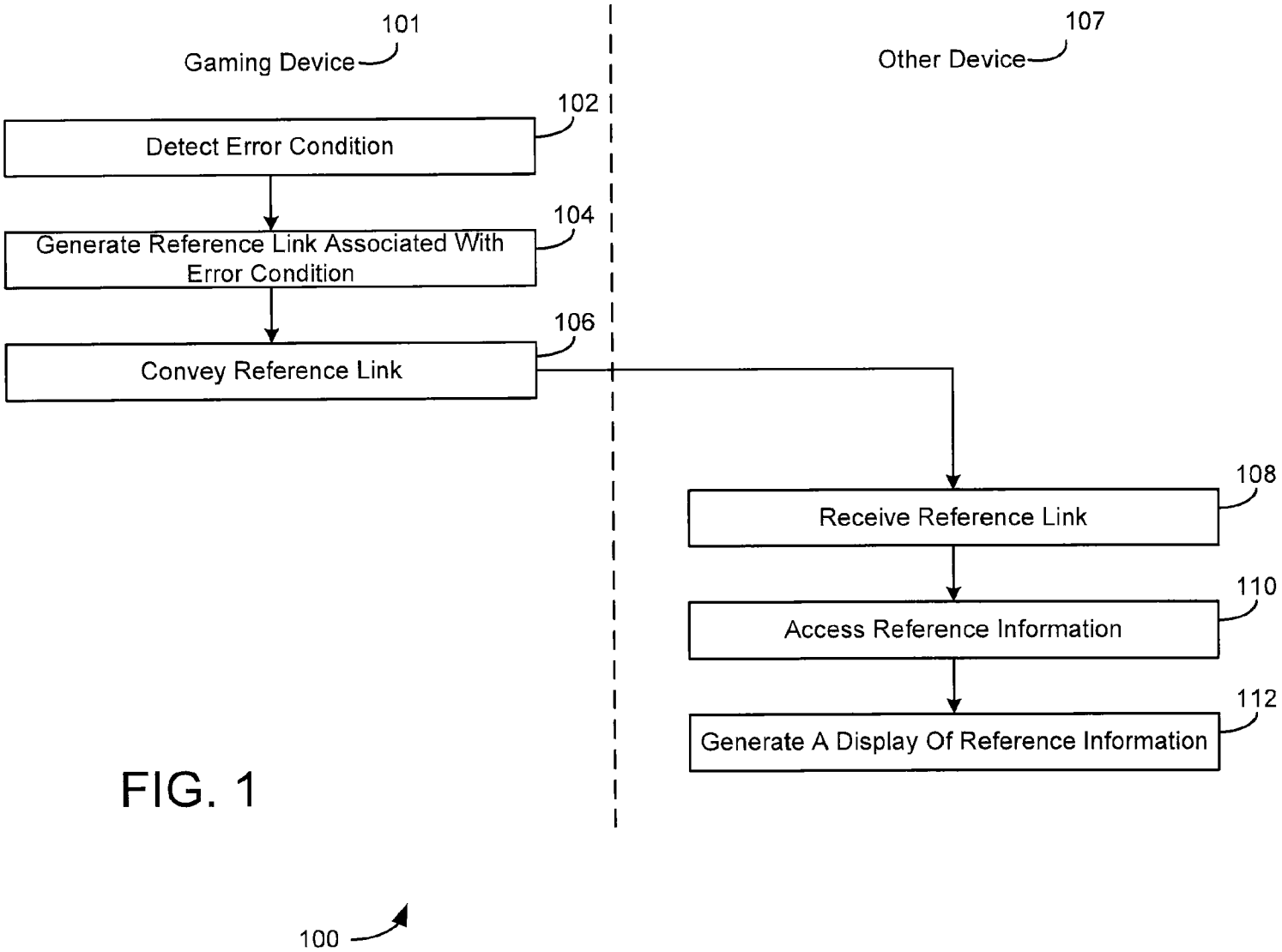
FIG. 1 is a flow diagram of a method to simplify device troubleshooting in accordance with described embodiments.

Referring to FIG. 1, a method for simplifying machine troubleshooting is described. As described herein, one or more of the steps may be performed by an application executing on an electronic gaming device or a mobile computing device. In some embodiments, a method is performed by a computer that provides a website accessible via a publicly accessible global computing network.

Figure 2:
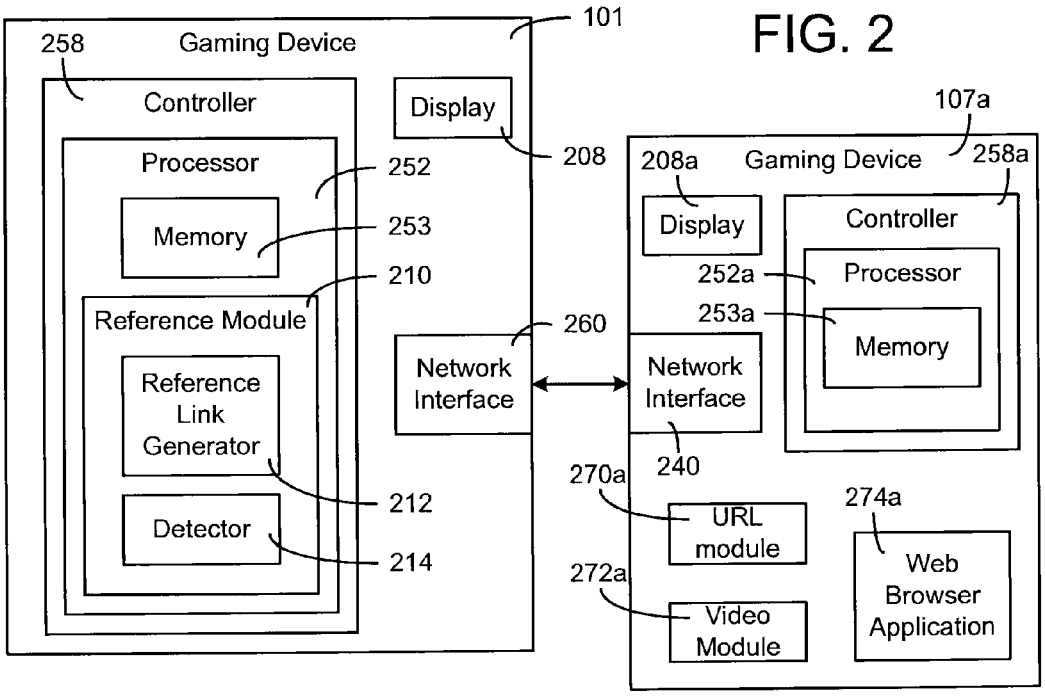
FIG. 2 illustrates an electronic gaming device and another gaming device configured in accordance with described embodiments.

At step 102, an error condition of an electronic gaming device 101, having a memory 253 and interface 260, may be detected. An error may be detected by an error detector 214 (as shown in FIG. 2) within an electronic gaming device 101. A detector 214 may be implemented as hardware (e.g., a watchdog timer circuit, voltage monitoring circuitry, oscillator/timer configuration, etc.). A detector 214 may also be implemented by error detection software, e.g., algorithm based fault tolerance, assertions, control flow checking, procedure duplication, automatic transformations, etc.

At step 104, a reference link is generated for a detected error condition. A reference link identifies an error condition of a device 101. A reference link is then conveyed, at step 106, to another device 107. Conveying a reference link may include downloading, storing, transmitting, displaying, printing, and pulsing a reference link. For example, a reference link may be electronically scanned, stored in memory for another application such as a diagnostic application, printed as a barcode or a QR code, broadcasted on any available communications network (SAS (Slot Accounting System), G2S (Game-to-System), Bluetooth, near field communications, Ethernet port/protocol, serial port/protocol, USB protocol, other external communications, SNMP (Simple Network Management Protocol) to report errors on Ethernet, etc.), pulsed via speakers (voice, audio, Morse code), flashed via a candle device 514 (shown in FIG. 5), and so on. The reference link may be a pointer to reference information useable by a technician to resolve the error condition at the gaming device 101. For example, in an embodiment where the reference information is delivered to the technician via a globally accessible public communication network (e.g., the Internet), the reference link may be a uniform resource locator (URL). In other embodiments, the reference link may be a pointer to a location in a paper or electronic reference manual (e.g., stored locally at device 101 and/or device 107), a unique error identifier, and so on. A reference link may be conveyed to a second device 107 via an interface 260 (shown in FIG. 2).

At step 108, a second device 107 receives a reference link, which identifies an error condition existing at a first electronic gaming device 101. At step 110, a second device 107, based on a reference link, accesses reference information associated with resolving an error (not apparent to the general public) condition. Reference information may include at least one of an electronic manual, a message, and a uniform resource locator (URL). For example, a reference manual may include an index to direct a repair technician to a particular location in a manual based on a particular reference link used as input to an index. As another example, a uniform resource locator (URL) may deliver a repair technician directly to a pertinent section of a website containing videos or other information useful for remedying an error condition. In another example, if a second device is a mobile computing device, then a reference information may be located on a downloadable application on a mobile computing device. At step 112, the other device 107 generates a display of a reference information to a user to facilitate resolving an error condition at a first electronic gaming device 101.

A second device may be a second electronic gaming machine, a mobile computing device, a server that provides a web site, a peripheral within the first electronic gaming device (e.g., a removable logging device that is disposed within the first electronic gaming device 101), and so on. If a second device is a second electronic gaming device, then a second electronic gaming device may be configured to enter a reference mode of operation responsive to an input received from a user. For example, an operator may press buttons 530 (FIG. 5) in a pre-designated sequence to cause a gaming device to enter a reference mode of operation. Other conditions (e.g., receipt of a Bluetooth or other signal from a first gaming device) may also be necessary for a second device to enter a reference mode of operation. In a reference mode of operation, a second electronic gaming device is configured to receive conveyance of a reference link from a first electronic gaming device (e.g., electronically, via manual input by a user, etc.) and, in response, display a reference information on a display of a second electronic gaming device. Information related to a reference link may be stored at a second device and transmitted to a gaming system server via a second device. A gaming system server may then securely log and track the stored information to determine characteristics and quantity of error conditions. For example, a gaming system server may track how frequently various errors may be occurring and use this information to detect patterns, direct efforts for future software revisions, and so on. In other embodiments, information regarding characteristics and quantity of error conditions may be logged at electronic gaming device 101 and/or second device 107. For example, a storage device disposed within device 101 and/or 107 may store a predetermined number of error codes (e.g., the n most recent error codes). The log record may later be retrieved via hardware or using a core dump for aggregation and analysis with other similar data obtained from other devices.

Referring to FIG. 2, an electronic gaming device 101 and a second electronic gaming device 107*a* are shown. An electronic gaming device 101 and a second electronic gaming device 107*a* may be configured to perform the method as described in FIG. 1.

An example configuration of an electronic gaming device 101 may include a display 208, a network interface 260, and a controller 258, a controller having one or more processors 252, memory 253 having instructions being executed by one or more processors 252, and a reference module 210 having a reference link generator 212 and a detector 214.

In some embodiments, a display 208 is configured to externally display a reference link. For example, a technician may use a display 208 of an electronic gaming device 101 to determine an error condition. In some embodiments, a display 208 is configured to audibly provide a reference link. In some embodiments, a display 208 is configured to visually display a reference link. A display 208 may be communicatively coupled to another item on a device 101 to display a reference link. For example, a display 208 may visually show a reference link, while telling a ticket acceptor 526 to print out a reference link.

In more detail, a processor 252 may include a reference module 210. A reference module 210 may include a reference link generator 212 and a detector 214. A reference link generator 212 may generate a reference link for characterizing a detected error condition. A detector 214 may determine whether an error condition has been found within an electronic gaming device 101.

A network interface 260 may be configured to receive a reference link from a controller 258. Although a network interface 260 is shown as one block, it should be understood that a network interface 260 may include a number of different types of interfaces (e.g., a communication interface). A network interface 260 is configured to convey a reference link to a second electronic gaming device 107*a* (e.g., via displaying, printing, flashing, broadcasting, etc., as discuss above). A gaming device 101 may use a repair technician as part of a communication mechanism when it conveys a reference link to a second electronic gaming device 107*a*.

A second electronic gaming device 107*a* includes a network interface 240, a controller 258*a* having a processor(s) 252*a*, a memory 253*a*, and other software applications such as a web browser application 274*a* with a URL module 270*a* and a video module 272*a*, and a display 208*a*.

An interconnection between a first device 101 and a second device 107*a* may be a direct connection or may be a network connection (e.g., FIG. 4), depending on the configuration. A direct connection between devices 101, 107*a* may be a cable connection using input/output ports (e.g., USB) on each device. A network connection may be through a cable modem, DSL, Bluetooth, or some other interfacing device, such as a network interfaces shown in FIG. 2. As another example, an interconnection may involve a repair technician manually entering a reference link at a gaming device 107*a*.

A controller 258*a* may include one or more processors 252*s*, memory 253*a*, and other software applications, such as a web browser application 274*a*. A controller 258*a* may be configured to enter a reference mode of operation responsive to an input received from a user. As another example, a gaming device 101 may transmit an electronic signal to a gaming device 107*a* which contains a reference links. Upon a repair technician thereafter pressing a predetermined sequence of keys, a gaming machine 107*a* enters a reference mode of operation and is ready to assist a repair technician with troubleshooting a first gaming device 101.

While in a reference mode of operation, a second electronic gaming device 107*a* is configured to receive conveyance of a reference link from a first electronic gaming device 101 via manual input by a user (i.e., if a reference link has not already been received electronically). In response, a second electronic gaming device 107*a* may display a reference information. In some embodiments, a second electronic gaming device 107*a* may be configured to access a reference information based on a reference link and associated with resolving an error condition. As discussed above, a reference information may include an electronic manual, message or a universal resource locator (URL) provided by a URL module 270*a*. In some embodiments, a reference information includes a video that is provided by a video module 272*a*. In some embodiments, a second electronic gaming device 107*a* includes a web browser application for a technician to access a number of URLs, videos, or other reference information from the Internet. In some embodiments, software applications may trigger event log entries for monitoring error conditions. Log entries may be received by a gaming system server to compile data relating to error conditions in a database.

A second electronic gaming device 107*a* is configured to display a reference information on display 208*a*. A display 208*a* is designed to provide a reference information to facilitate troubleshooting a first electronic gaming device 101.

Figure 3:
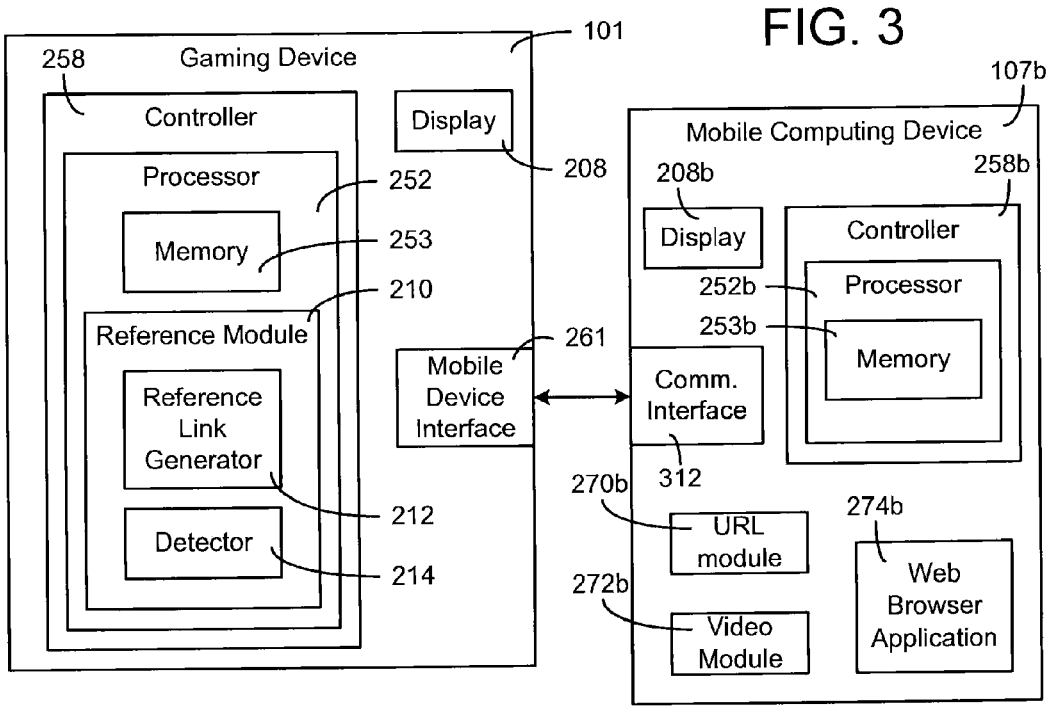
FIG. 3 illustrates an electronic gaming device and a mobile computing device configured in accordance with described embodiments.

Referring to FIG. 3, an electronic gaming machine and a mobile computing device are configured in accordance with described embodiments. A gaming machine 101 and a mobile computing device 107*b* may be configured to perform a process as described above in FIG. 1. In FIG. 3, an electronic gaming device 101 comprises same components as shown in FIG. 2.

A mobile computing device 107*b* also includes a network interface 240 for receiving a reference link via an interconnection between a mobile device interface 261 and a communication interface 312, a controller 258*b* having a processor (s) 252*b*, a memory 253*b*, and other software applications such as a web browser application 274*b* with a URL module 270*b* and a video module 272*b*, and a display 208*b*.

Additionally, via a communication path, a processor 252*b* is connected to a mobile device interface 261. Although a mobile device interface 312 is shown as one block, it should be understood that a mobile device interface 312 may include a number of different types of interfaces (e.g., a communication interface, network interface, etc.). A mobile device interface 312 may be configured to receive a reference link from a controller 258*b*. A gaming device interface 312 is configured to convey a reference link to a mobile computing device 107*b*. In some embodiments, a reference link may be scanned by a mobile computing device 107 to receive a reference link from a first electronic gaming device 101. In other embodiments, a reference link may be manually entered.

A controller 258*b* may include one or more processors 252*b*, memory 253*b*, and other software applications, such as a web browser application 274*b*. A controller 258*b* may be configured to receive conveyance of a reference link from a first electronic gaming device 101 via manual input by a user.

A controller 258*b* may be further configured to communicate to a mobile application, interface, I/O ports, etc. to receive a reference link. In some embodiments, a user may directly enter a reference link into a diagnostic application that a gaming machine manufacturer has created. A diagnostic application may be pre-installed on a mobile computing device 107*b* or downloadable from a mobile software platform within a gaming device environment. In some embodiments, an application may be downloadable from a device via wireless or direct connection. A mobile computing device 107*b* accesses, based on a reference link, reference information associated with resolving an error condition and displays a reference information.

In response, a mobile computing device 107*b* may display a reference information. As discussed above, a reference information may include an electronic manual, message or a universal resource locator (URL) provided by a URL module 270*b*. In some embodiments, a reference information includes a video that is provided by a video module 272*b*. In some embodiments, a mobile computing device 107*b* includes a web browser application for a technician to access a number of URLs, videos, or other reference information from the Internet. In some embodiments, software applications may trigger event log entries for monitoring error conditions. Log entries may be received by a gaming system server to compile data relating to error conditions in a database.

A mobile computing device 107*b* is configured to display a reference information on display 208*b*. A display 208*b* is designed to provide a reference information to facilitate troubleshooting a first electronic gaming device 101.

Figure 4:
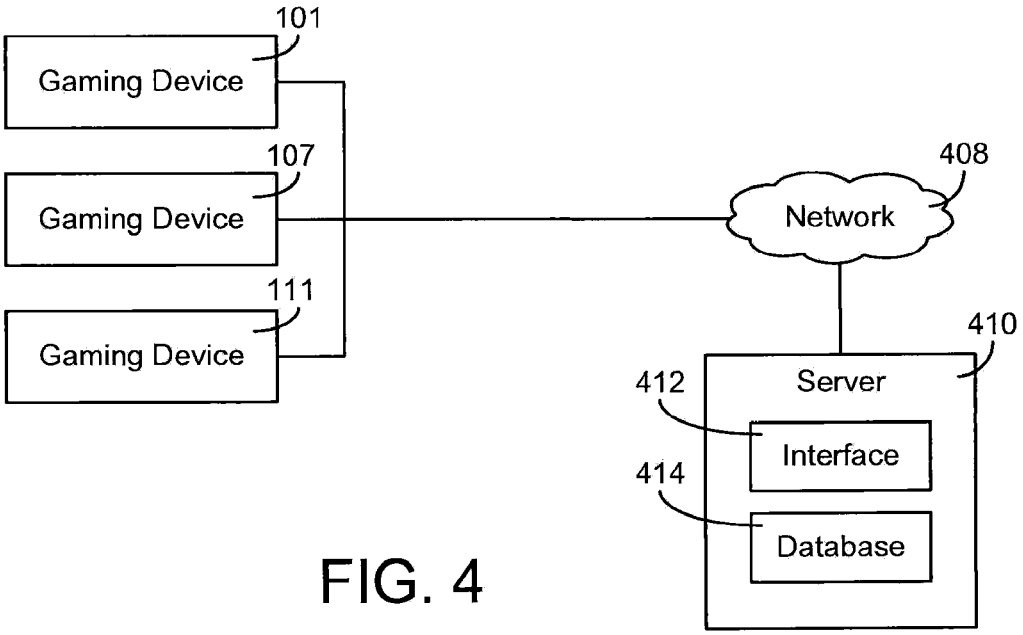
FIG. 4 is a schematic diagram of a gaming network in accordance with described embodiments.

Referring to FIG. 4, a gaming network configured in accordance with the described embodiments is shown. It is a simplified diagram depicting gaming devices 101, 107, 111 within a gaming environment connecting to a server 410 including interfaces 412 and a database 414 via a network 408 (e.g., a communications network). In some embodiments, server 410 includes a database 414. Server 410 is not limited to one server, but may include multiple servers. In some embodiments, another server may be connected between a network and gaming devices.

According to an exemplary embodiment, a network 408 may connect gaming devices 101, 107, 111 to a server 410 in order to track the performance of devices. For example, reference information at a second electronic gaming device or mobile computing device related to a reference link may be stored and transmitted to a server 410 via an interconnection, wherein a server 410 logs and tracks stored information to determine characteristics and quantity of error conditions. Systems of gaming devices 101, 107, 111 or a server 410 may communicate data onto a network 408 via communications interfaces 412 and network interfaces 240, 260.

Gaming devices may provide data to a host server via a network. Gaming devices may receive data from a host server communicated on a network. Data may be synchronously sent to gaming devices on a network. Gaming devices may be typically located on a casino floor, whereas a server is usually located in another part of a casino, e.g., an enclosed room. However, gaming devices and server may be located anywhere. Gaming devices may be connected through various communication paths and interfaces that allow communication between gaming devices and a server via a network.

Although there is one network and three gaming devices, shown in FIG. 4, it should be understood that different number of servers, networks and gaming devices may be utilized. For example, network 408 may include a plurality of networks and tens or hundreds of gaming devices, which may be interconnected via wireless or connected communication links. If a network comprises a Internet, then communication may take place over a communication link via Internet communication protocol.

Network architecture may include a central processing unit (CPU), interfaces 412, and a bus (e.g., a PCI, PCIe, PCI-X, etc.). A processing unit may implement certain functions along with network functions. Software and/or firmware may control a CPU, along with an operating system and other applications.

A central processing unit may include one or more processors, either a general-purpose, commercial microprocessor or a specially designed processor for a network device. Memory of a central processing unit may be RAM (and variations such as SRAM, DRAM, BRAM, etc.), ROM (and variations such as EPROM, EEPROM, etc.), Flash, and any other physical device used to store programs, data or other information. Memory may be configured to a system in a variety of ways. For example, tightly coupled memory may be used to handle interrupt routines or real time tasks. Regardless of implementation, memory may be configured to store data, instructions, and any other information related to implementations described herein. Instructions may further control a operating system and other applications.

An interfaces 412 control interaction between components, i.e., sending and receiving of data over a network and/or between a network and peripheral devices. Interfaces may include ports for communication with a respective application. Interfaces may also include at least one processor and a memory. A processor may be an ASIC, FPGA, or other processor that may perform some of the functions of logic described herein. Interfaces may control tasks such as compression, encryption, application management, etc in combination with their individual processors. Any type of network interface may be used.

Other network architectures may be used. For example, a single processor that processes communications and routing may be used. Other interfaces and/or types of media may be use with a network. Communication paths may be bus-based, switch-based, hybrid-based, etc.

Figure 5:
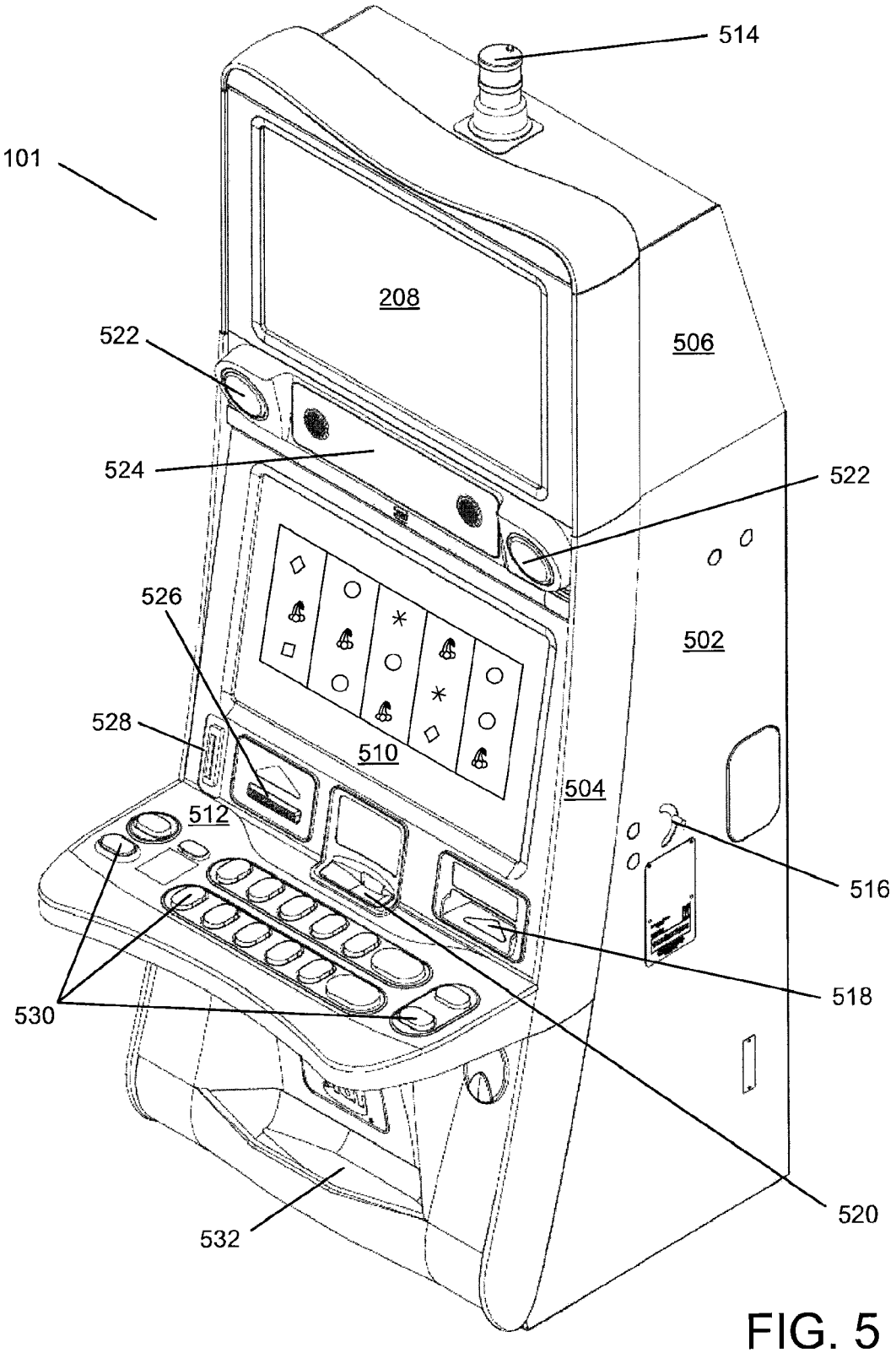
FIG. 5 is a perspective view of an electronic gaming device in accordance with described embodiments.

Referring to FIG. 5, a perspective drawing of an electronic gaming device 101 is shown in accordance with described embodiments. A gaming device 101 is an example of what may be considered a "thick-client." Typically, a thick-client is configurable to communicate with one or more remote servers but provides game play, such as game outcome determination, independent of remote servers. In addition, a thick-client may be considered as such because it includes cash handling capabilities, such as peripheral devices for receiving cash, and a secure enclosure within a device for storing received cash. In contrast, thin-client device, such as a mobile gaming device, may be more dependent on a remote server to provide a component of a game play on a device, such as game outcome determination, and/or may not include peripheral devices for receiving cash and an associated enclosure for storing it.

Many different configurations may be possible between thick and thin clients. For instance, a thick-client device, such as 101, deployed in a central determination configuration, may receive game outcomes from a remote server but still provide cash handling capabilities. Further, peripheral devices may vary from gaming device to gaming device. For instance, a gaming device 101 may be configured with electro-mechanical reels 510 to display a game outcome instead of a video display. Thus, features of gaming device 101 are described for purposes of illustration only and may not be limiting.

A gaming device 101 may include a main cabinet 502. A main cabinet 502 may provide a secure enclosure that prevents tampering with device components, such as a game controller (not shown) located within the interior of a main cabinet and monetary devices including a coin acceptor 520, a ticket printer 526 a bill acceptor 518, a card reader 528, and a coin hopper (not shown). These devices may provide value input/output capabilities on a gaming device 101. For example, a printer 526 may be used to print out tickets redeemable for cash or additional game play. Tickets generated by printer 526 as well as printers on other gaming devices may be inserted into bill and ticket acceptor 518 to possibly add credits to a gaming device 101. After a ticket is authenticated, credits associated with a ticket may be transferred to a gaming device 101.

A device 518 may also be used to accept cash bills. After a cash bill is authenticated, it may be converted to credits on a gaming device and used for wager-based game play. A coin acceptor 520 may be configured to accept coins that may be legal tender or tokens, such as tokens issued by a casino enterprise. A coin hopper (not shown) may be used to dispense coins that may be legal tender or tokens into a coin tray 532.

Although monetary devices may be shown as separate components, an input device may be implemented, which accepts currency coins, bills, tickets, cards, electronic cash, game tokens and also includes a return button and return slot.

A main cabinet may include an access mechanism, such as door 504, which allows an interior of a gaming device 101 to be accessed. Actuation of a door 504 may be controlled by a locking mechanism 516. A locking mechanism 516, a door 504 and the interior of a main cabinet 502 may be monitored with security sensors of various types to detect whether the interior has been accessed. For instance, a light sensor may be provided to detect a change in light-level in response to a door 504 being opened.

The interior of a main cabinet 502 may include additional secure enclosure, which may also be fitted with locking mechanisms. For instance, a game controller 258, shown in FIG. 6, may be secured within a separate locked housing. A separate locked housing for a game controller 258 may allow maintenance functions to be performed on a gaming device 101, such as emptying a drop box for coins, emptying a cash box or replacing a device, while preventing tampering with a game controller 258. Further, in a case of device with a coin acceptor, 520, a separate housing may protect electronics of a game controller 258 from potentially damaging coin dust.

A top box 506 may be mounted to the top of a main cabinet 502. A number of peripheral devices may be coupled to a top box 506. A display 208 and a candle device 514 may be mounted to a top box 506. A display 208 may be used to display information associated with game play on a gaming device 101. For instance, a display 208 may be used to display a bonus game presentation associated with a play of a wager-based game (One or more bonus games may often be features of many wager-based games). In another example, a display 208 may be used to display information associated with a progressive game, such as one or more progressive jackpot amounts. In yet another example, a display 208 may provide visual feedback (e.g., images, lights, score displays) that is intended to draw a potential player's attention to a gaming device 101 when it is not in use.

A candle device 514 may include a number of lighting elements. Lighting elements may be lit in different patterns to draw attention to a gaming device. For instance, one lighting pattern may indicate that service is needed at a gaming device 101 while another light pattern may indicate that a player has requested a drink. A candle device 514 is typically placed at the top of gaming device 101 to increase its visibility. Other peripheral devices, including custom bonus devices, such as reels or wheels, may be included in a top box 506. For instance, some devices coupled to a main cabinet 502, such as printer 526, may be located in a different top box configuration.

A gaming device 101 provides a user interface 659 that allows a play of a game, such as wager-based game. A user interface 659 may be a graphical user interface, a command-line interface, etc. A user interface 659 may include non-screen gaming regions, such as electro-mechanical reels 510, audio devices 522, input panel 512, and a display 208. In various embodiments, a user interface may include a website display screen for providing additional information to a player or providing reference information to a technician. In some embodiments, user interface 659 may include a service window that is presented by display 208 and that that delivers reference information, e.g., to a game player or to a technician, depending on a mode of operation of gaming device 101. The service window may implement G2S open protocol for easy integration.

An audio devices 522 may include buzzers, alarms, speakers, or any other type of device to provide auditory feedback. An input panel 512 provides game play related inputs. For example, an input panel may include buttons, switches, a keyboard, joystick controls, a touch screen, a mouse, a pointing mechanism, a steering wheel, foot pedals, dials, voice-controlled input, and any other input used to play a game and/or make selections. An input panel may also include a touch screen equipped video display to provide a touch sensitive surface. In some embodiments, functions of an electro-mechanical input buttons may be dynamically reconfigurable. For instance, function of electro-mechanical input buttons may be changed depending on a game that is being played on a gaming device. To indicate function changes, input buttons may each include a configurable display, such as an e-ink or a video display for indicating a function of button. Output of a configurable display may be adjusted to account for a change in the function of a button.

A display 208 provides video content related to a game play (e.g., bonus material) and/or a casino enterprise (e.g., advertising). In particular embodiments, one or both of displays, 208 and 510, may be equipped with a touch screen sensor and associated touch screen controller, for detecting touch inputs, such as touch inputs associated with a play of a game or a service window output to a display device.

A display 208 is also visible on a main cabinet 502. A display 208 may communicate with a user through use of codes, such as scannable codes, such as QR codes, that a user could scan using their own mobile computing device. For example, a rewards club and/or point-based system for a gaming system could be downloadable by a user using a mobile computing device by scanning a code from an electronic gaming device 101. A display 208 may also be used to display reference information associated with resolving an error condition of electronic gaming device 101. For example, a user may be able to scan a reference link to access reference information to easily troubleshoot an electronic gaming device 101.

Figure 6:
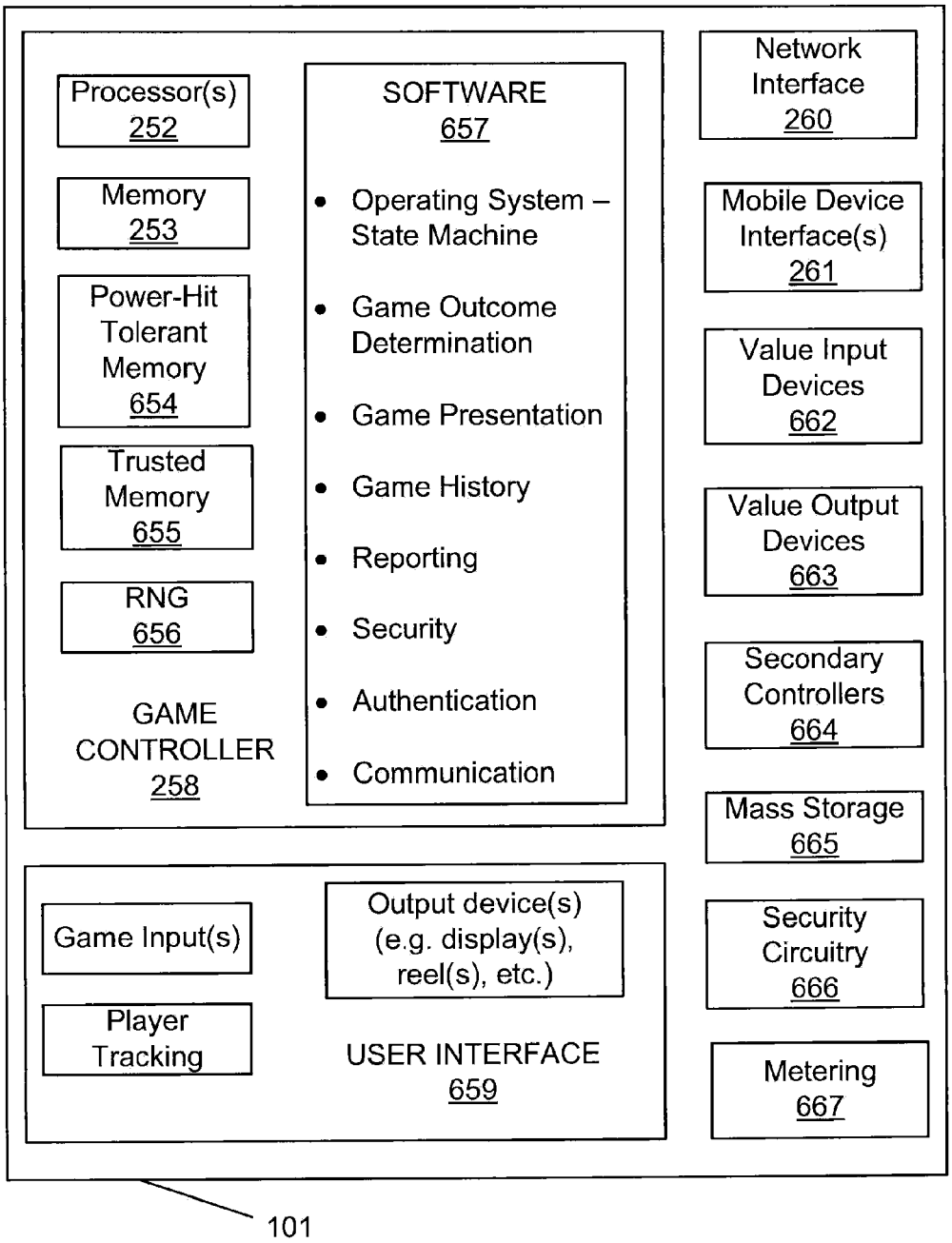
FIG. 6 is a block diagram of an electronic gaming device in accordance with described embodiments.

Referring to FIG. 6, a block diagram of an electronic gaming device 101 is shown in accordance with described embodiments. An electronic gaming device 101 may include a game controller 258, a user interface 659, a network interface 260, mobile device interface(s) 261, value input devices 662, value output devices 663, secondary controllers 664, mass storage 665, security circuitry 666, and metering 667.

An electronic gaming device 101 may be configured with a user interface 659 that allows input from a user or player, such as a wager amount, associated with a wager-based game to be made. In further embodiments, a user interface 659 facilitates communication of an outcome of a game or other information related to a game to a player or user. Outcome of a game is displayed, shown, described, transmitted, or otherwise communicated to a player or user or another device through output device 663.

An output device 663 may include, but is not limited to, one or more electro-mechanical reels, video displays, any visible or audible devices that disclose or describe an outcome of a game, network devices that communicate an outcome of a game to another device, or the like.

An electronic gaming device 101 may further include a game controller 258 for controlling a wager-based game played on electronic gaming device 101. A game controller 258 may include one or more processors 252, memory 253 for storing or holding instructions executed by one or more processors 252, power-hit tolerant memory 654, one or more trusted memories 655, random number generator 656, and software application(s) 657. Components of a game controller 258 and/or one or more of a user interface 659 may be coupled, directly or indirectly, via a system bus.

A processor 252 may be configured (by hardware, software, or both) to perform functions described herein. In various embodiments, a processor 252 transmits information to an output device 663. Some embodiments of the present disclosure use just one processor 252 in a gaming device 101. Other embodiments use multiple processors 252. In some embodiments involving multiple processors 252, processors 252 are in a same gaming device 101. In other embodiments, processors 252 are distributed among a network of gaming device(s) 101, server(s), and/or other devices.

In various embodiments, a memory 655 is any non-transitory data-storage device that may store data which may thereafter be read by a system that executes software 657. Examples of a memory 655 include, but may not be limited to, read-only memory (ROM), random-access memory (RAM), CD-ROMs, DVDs, electrically erasable programmable read-only memory (EEPROM), field programmable gate array (FPGA), flash memory, compact disk, magnetic tape, magnetic disk, and other magnetic storage devices, and optical data-storage devices, or the like. In some embodiments, a memory 655 is distributed over network-coupled systems so that a software 657 is stored and executed in a distributed fashion. In various embodiments, a non-transient memory 655 includes volatile memory, non-volatile memory, and/or combinations of volatile and non-volatile memory.

Each electronic gaming device includes hardware and methods for recovering from operational difficulties, such as power failure, device failure, tilts, etc. Therefore, gaming device software logic and, in particular, a processor may be designed to generate a number of states where critical information is generated during each state and stored within memory (typically, non-volatile). In this "state" machine architecture, a electronic gaming device does not advance to a next state until it is confirmed that critical information has been stored within a memory. For example, if an error condition occurs between two states, a gaming device may likely be restored to its last state prior to occurrence of an error using critical information associated with a last state stored within a memory.

In more detail, state machine architecture identifies critical information in each state queues information for storage to persistent memory. Architecture does not advance to a next state from a current state until all of the critical information that is queued for storage for a current state is stored to persistent memory. Thus, if an error condition occurs between two states, such as a power failure, a gaming device 101 implementing a state machine may likely be restored to its last state prior to an occurrence of an error condition using the critical information associated with its last state stored in persistent memory. This feature is often called a "roll back" of a gaming device. Examples of critical information may include, but may not be limited to, an outcome determined for a game, a wager amount made on a wager-based game, an award amount associated with an outcome, credits available, and/or amount of credits deposited to a gaming device 101.

According to various embodiments, a power-hit tolerant memory 654 is used as persistent memory for critical data, such as critical data associated with maintaining a state machine on a gaming device 101. In some embodiments, one characteristic of a power-hit tolerant memory 654 is a fast data transfer time. Thus, in an event of a power-failure, which might be indicated by a sudden power fluctuation, critical data may be quickly loaded from volatile memory, such as RAM associated with a processor 252, into a power-hit tolerant memory 654 and saved.

In some embodiments, a gaming device 101 is configured to detect power fluctuations and in response, trigger a transfer of critical data from RAM to a power-hit tolerant memory 654. One non-limiting example of a power-hit tolerant memory 4 is a battery-backed RAM. The battery supplies power to the normally volatile RAM so that in the event of a power failure, data is not lost. Thus, a battery-backed RAM is also often referred to as a nonvolatile RAM or NV-RAM. An advantage of a battery-backed RAM is that the fast data transfer times associated with a volatile RAM may be obtained.

In various embodiments, the trusted memory 655 is ROM of some type that may be designed to be unalterable. An EPROM or EEPROM are two types of memory that may be used as a trusted memory 655, but it is not limited to those types. In other embodiments, other types of memories, such as Flash memory, is utilized as an unalterable memory. In various embodiments, a gaming device 1 includes one or more trusted memories.

Prior to installation, contents of a trusted memory 655 may be verified. For instance, a unique identifier, such as a hash value, may be generated on contents of the memory and then compared to an accepted hash value for contents of the memory. Memory may not be installed if generated and accepted hash values do not match. After installation, a gaming device 1 may be configured to check contents of a trusted memory 655. For instance, a unique identifier, such as a hash value, may be generated on contents of a trusted memory 655 and compared to an expected value for a unique identifier. If a generated value of a unique identifier and an expected value of a unique identifier do not match, then an error condition may be generated on a gaming device 101. In one embodiment, an error condition may result in a gaming device 1 entering a "tilt" state in which game play is temporarily disabled on a gaming device 101.

Sometimes, verification of software executed on a gaming device 101 may be performed by a regulatory body, such as a government agency. Often software used by a game controller 258 may be highly regulated, where only software approved by a regulatory body is allowed to be executed by a game controller 658. In some embodiments, a trusted memory 655 may store authentication programs and/or authentication data for authenticating contents of various memories on a gaming device 101. For instance, in some embodiments, a trusted memory 655 may store an authentication program that may be used to verify contents of a mass storage device, which may include software executed by a game controller 258.

According to various embodiments, a RNG 656 is used to generate random numbers for use in determining outcomes for a game of chance played on a gaming device 101. In one non-limiting, exemplary embodiment of a mechanical or video slot reel type of game, a RNG 656, in conjunction with a paytable that lists possible outcomes for a game of chance and associated awards for each outcome, may be used to generate random numbers for determining reel positions that display randomly determined outcomes to a game. Typically, as described above, outcomes generated on an electronic gaming device 101 may be considered critical data. Thus, in various embodiments, generated outcomes may be stored to a power-hit tolerant memory 654.

Not all electronic gaming devices 101 may be "thick" clients, that is, they may not be all configured to generate their own game outcomes and thus may not use a RNG 656 for this purpose. In some embodiments, game outcomes may be generated on a remote device, such as server, and then transmitted to an electronic gaming device 101 where an outcome and an associated award may be displayed to a user via a user interface 659.

In other embodiments, a thin-client type electronic gaming device 101, such as a mobile gaming device, is configured to receive at least game outcomes from a remote device and not use a RNG 656 to generate game outcomes locally. Game outcomes may be generated remotely in response to inputs made on a mobile device, such as, but not limited to, an input indicating a wager amount and/or an input to initiate a game. In some embodiments, this information is sent from a mobile device to a remote device. After receiving a game outcome from a remote device, a game presentation for a game outcomes generated remotely may be generated and displayed on a mobile device. In some embodiments, a game presentation may also be generated remotely and then streamed for display to a mobile device.

A game controller 258 may be configured to utilize and execute many different types of software applications 657. Typically, a software applications 657 utilized by a game controller 258 may be highly regulated and may undergo a lengthy approval process before a regulatory body allows a software applications 657 to be utilized on an electronic gaming device 101 deployed in a field, such as in a casino. In various embodiments, one type of software application 657 a game controller 258 may utilize is an Operating System (OS). An OS allows various programs to be loaded for execution by a processor 252, such as programs for implementing a state machine on an electronic gaming device 101. Further, an OS may be used to monitor resource utilization on an electronic gaming device 101. For instance, certain applications, such as applications associated with game outcome generation and game presentation that may be executed by an OS, may be given higher priority to resources, such as a processor 252 and memory 253, than other applications that may be executing simultaneously on a gaming device.

As previously described, a electronic gaming device 101 may execute software 657 for determining an outcome of a game and generating a presentation of a determined game outcome including displaying an award for a game. As part of a game outcome presentation, one or more of 1) electromechanical devices, such as reels or wheels, may be actuated, 2) video content may be output to video displays, 3) sounds may be output to audio devices, 4) haptic responses may be actuated on haptic devices (i.e., touch-screens, touch-sensitive displays, or any type of tactile device) or 5) combinations thereof, may be generated under control of a game controller 258. In some embodiments, peripheral devices used to generate components of a game outcome presentation may be associated with a user interface 659 where types of devices that may be utilized for a user interface 659 vary from device to device.

Various aspects, embodiments, implementations or features of described embodiments may be used separately or in any combination. Various aspects of described embodiments may be implemented by software, hardware or a combination of hardware and software. A computer readable medium is any data storage device that may store data which may thereafter be read by a computer system. Examples of a computer readable medium include read-only memory, random-access memory, CD-ROMs, DVDs, magnetic tape and optical data storage devices. A computer readable medium may also be distributed over network-coupled computer systems so that a computer readable code is stored and executed in a distributed fashion.

A foregoing description, for purposes of explanation, used specific nomenclature to provide a thorough understanding of the disclosure. However, it may be apparent to one skilled in an art that specific details may be not required in order to practice the disclosure. Thus, foregoing descriptions of specific embodiments of the present disclosure are presented for purposes of illustration and description. They may not be intended to be exhaustive or to limit the disclosure to the precise forms disclosed. It may be apparent to one of ordinary skill in an art that many modifications and variations may be possible in view of the above teachings.

Embodiments were chosen and described in order to best explain principles of the disclosure and its practical applications, to thereby enable others skilled in an art to best utilize the disclosure and various embodiments with various modifications as may be suited to a particular use contemplated. It is intended that a scope of a disclosure be defined by the following claims and their equivalents.

While embodiments have been described in terms of several particular embodiments, there may be alterations, permutations, and equivalents, which fall within the scope of these general concepts. It should also be noted that there may be many alternative ways of implementing methods and apparatuses of present embodiments. It is therefore intended that the following appended claims be interpreted as including all such alterations, permutations, and equivalents as fall within the true spirit and scope of described embodiments.

What is claimed is:

1. A method in a gaming system having a first electronic gaming device and a second electronic gaming device, the method comprising:

detecting an error condition of the first electronic gaming device through a processor of the first electronic gaming device, the first electronic game device having the processor, a memory and an interface, the first electronic gaming device configured to provide game play of a game;

generating a reference link for the detected error condition by the processor of the first electronic gaming device, wherein the reference link is a pointer or locator to information relating to the error condition of the first electronic gaming device;

conveying the reference link to the second electronic gaming device, the second gaming device configured to provide game play of the game;

receiving the reference link at an interface of the second electronic gaming device;

transitioning the second gaming device from a game play mode to a reference mode; and presenting the information relating to the error condition of the first electronic gaming device to a user of the second electronic gaming device via a display of the second electronic gaming device.

2. The method of claim 1, wherein the reference link is conveyed to the second electronic gaming device via an interface of the first electronic gaming device, and wherein the information relating to the error condition of the first electronic gaming device is reference information associated with resolving the error condition.

3. The method of claim 1, wherein the second electronic gaming device is configured to enter a reference mode of operation responsive to an input received from a user prior to presenting the information via the display of the second electronic gaming device, and wherein, in the reference mode of operation, the second electronic gaming device is configured to receive conveyance of the reference link via manual input by the user and, in response, presenting the information relating to the error condition of the first electronic gaming device to the user of the second electronic gaming device via the display of the second electronic gaming device.

4. The method of claim 3, wherein the input received from the user corresponds to a predetermined sequence of button presses of a user input of the second electronic gaming device.

5. The method of claim 1, wherein the reference link is a uniform resource locator.

6. The method of claim 1, wherein conveying the reference link includes printing the reference link.

7. The method of claim 6, wherein the printed reference link is a barcode or a QR code.

8. The method of claim 1, further comprising:

storing information at a memory of the second gaming device related to the reference link; and transmitting the stored information to a gaming system server via an interface of the second gaming device, wherein a gaming system server logs and tracks stored information to determine characteristics and quantity of error conditions.

9. The method of claim 1, wherein the information relating to the error condition of the first electronic gaming device includes a video presenting information for remedying the error condition.

10. The method of claim 1, wherein the information relating to the error condition of the first electronic gaming device relates to a particular location of a manual.

11. The method of claim 1, wherein the error condition is detected via a watchdog timer circuit of the first electronic gaming device.

12. A system comprising:

a first electronic gaming device configured to provide game play of a game, wherein the first electronic gaming device includes a processor, a memory, an interface, a detector configured to detect an error condition of the first electronic gaming device, and a reference link generator configured to generate a reference link characterizing the error condition, wherein the reference link is a pointer or a locator to information relating to the error condition;

a second electronic gaming device configured to provide game play of a game, wherein the second electronic gaming device includes an interface and a display, wherein the second electronic gaming device is configured to receive the reference link from the first electronic gaming device, to transition from a game play mode to a reference mode, and to present the information relating to the error condition via the display.

13. The system of claim 12, wherein the reference link is conveyed to the second device via the interface, and wherein the information relating to the error condition relates to reference information associated with resolving the error condition.

14. The system of claim 12, wherein the second electronic gaming device is configured to enter a reference mode of operation responsive to an input received from a user prior to presenting the information via the display of the second electronic gaming device, and wherein, in the reference mode of operation, the second electronic gaming device is configured to receive conveyance of the reference link via manual input by the user and, in response, presenting the information relating to the error condition of the first electronic gaming device to the user of the second electronic gaming device via the display of the second electronic gaming device.

15. The system of claim 12, wherein the reference link is a uniform resource locator.

16. A non-transitory computer readable storage medium having instructions thereon that, when executed by a processor, cause the processor to perform a method comprising:

receiving, at a second electronic gaming machine, a reference link identifying an error condition existing at a first electronic gaming machine, wherein the first and second electronic gaming machines are both configured to provide game play of a wager based game;

transitioning, at the second gaming machine, from a game play mode to a reference mode;

accessing, at the second electronic gaming machine and based on the reference link, reference information associated with resolving the error condition existing at the first electronic gaming machine, and presenting, via a display of the second electronic gaming machine, the reference information to a user to facilitate resolving the error condition at the first electronic gaming device.

17. The medium of claim 16, further comprising instructions for entering a reference mode of operation at the second electronic gaming machine responsive to an input received from a user.

18. The medium of claim 16, wherein reference link includes a uniform resource locator.

* * * * *